United States Patent [19]

Lindquist et al.

[11] 4,227,725

[45] Oct. 14, 1980

[54] SLIDING CLOSURE LOCK LATCH

[76] Inventors: Morris W. Lindquist, 24155 Loretta, Warren, Mich. 48091; Henry P. Hines, 7450 Brentwood, Detroit, Mich. 48234

[21] Appl. No.: 971,843

[22] Filed: Dec. 21, 1978

[51] Int. Cl.[2] ..... E05C 3/04

[52] U.S. Cl. ..... 292/202; 292/305; 292/DIG. 46; 292/DIG. 47

[58] Field of Search ..... 292/271, 272, 305, DIG. 46, 292/DIG. 47, DIG. 30, 238, 202

[56] References Cited

U.S. PATENT DOCUMENTS

| | | | |
|---|---|---|---|
| 345,483 | 7/1886 | Cole | 292/305 |
| 346,516 | 8/1886 | Tankersly | 292/209 |
| 1,618,353 | 2/1927 | Rice | 292/272 X |
| 1,747,707 | 2/1930 | Grosse | 292/271 X |
| 2,481,329 | 9/1949 | Monat | 292/207 |
| 2,560,656 | 7/1951 | Melnick | 292/202 |
| 2,683,049 | 7/1954 | Van Der Spek | 292/238 X |
| 3,352,586 | 11/1967 | Hakanson | 292/DIG. 46 |

FOREIGN PATENT DOCUMENTS

| | | | |
|---|---|---|---|
| 173656 | 12/1934 | Switzerland | 292/272 |

*Primary Examiner*—Richard E. Moore

*Attorney, Agent, or Firm*—Barnes, Kisselle, Raisch & Choate

[57] ABSTRACT

A lock latch assembly for sliding closures (windows and patio doors) which is placed to limit the opening of such closures beyond an adjusted position and which prevents access through the closure opening. A simple integral notched plate as one element and a swiveled pin as a second element provides the structure, each held by fasteners which have substantially resistance in shear to any forcing of the closures.

1 Claim, 6 Drawing Figures

SLIDING CLOSURE LOCK LATCH

FIELD OF INVENTION

Locks for sliding closures to limit the degree of opening to prevent forced entry.

BACKGROUND OF THE INVENTION

Windows which slide to open positions and doors, such as patio doors, which slide, are frequently furnished with locks to secure them when in closed position. However, when these closures are unlocked and partially open, there is no protection against further unauthorized opening from the outside.

This problem has been previously addressed by inventors as evidenced by the following U.S. Pat. Nos.:

| | | |
|---|---|---|
| 345,779 | July 20, 1886 | Gilman |
| 887,690 | May 12, 1908 | Pearce |
| 2,481,329 | Sept. 6, 1949 | Monat |

The present invention is intended as an improvement over previous devices in the simplicity of the design and the ease of installation on existing windows and sliding doors by the average householder.

It is, therefore, an object of the present invention to provide a latch lock which can be readily installed on existing windows and doors and which is unobstrusive in appearance and simple to operate. It is a further object to provide a lock which may be installed out of reach of an intruder to prevent opening of a closure beyond the point established by the occupant.

Other objects and features of the invention will be apparent in the following description and claims in which the principles of the invention are set forth, together with details to enable a person skilled in the art to practice the invention.

BRIEF DESCRIPTION OF THE DRAWINGS

Drawings accompany the disclosure, and the various views thereof may be briefly defined as follows.

Figure 1:
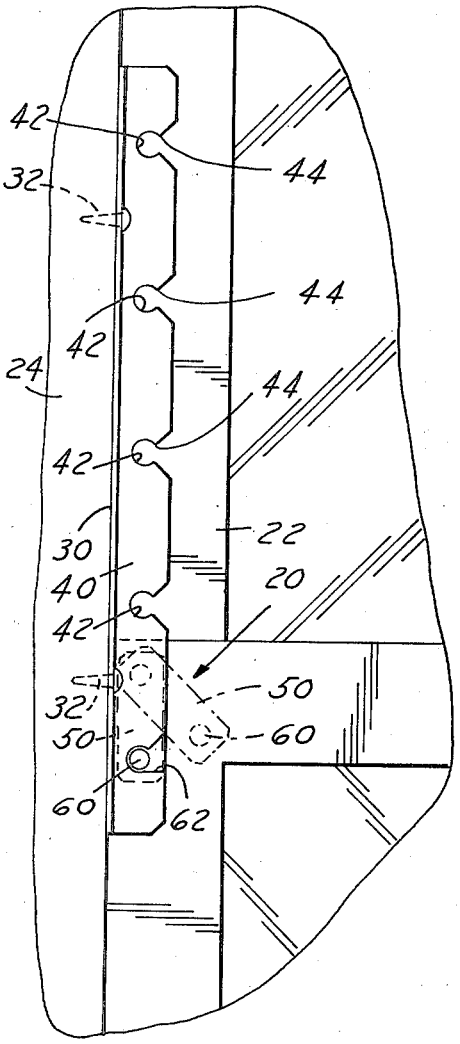
FIG. 1, an elevation of an installed lock latch.
Figure 2:
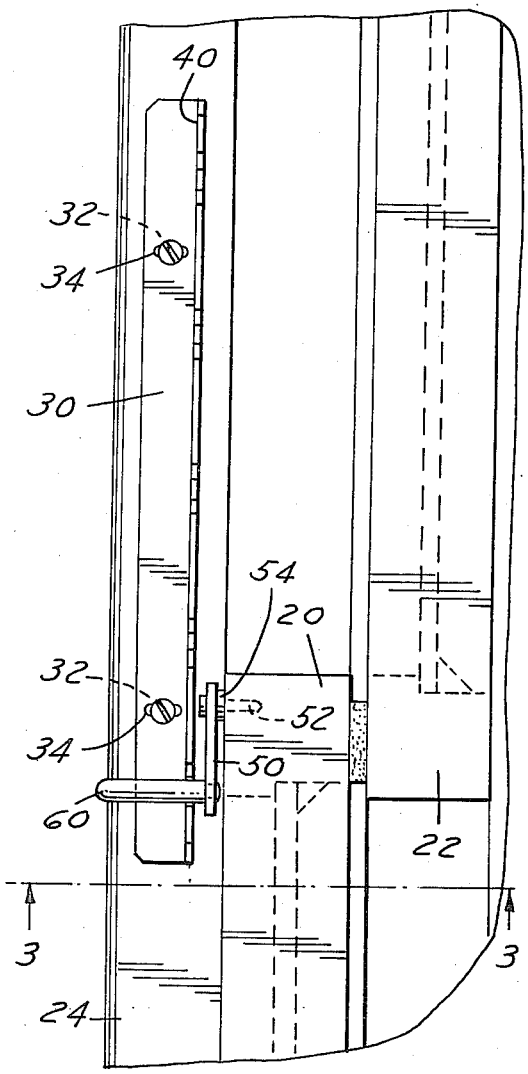
FIG. 2, a sectional view showing the parts in assembly.
Figure 3:
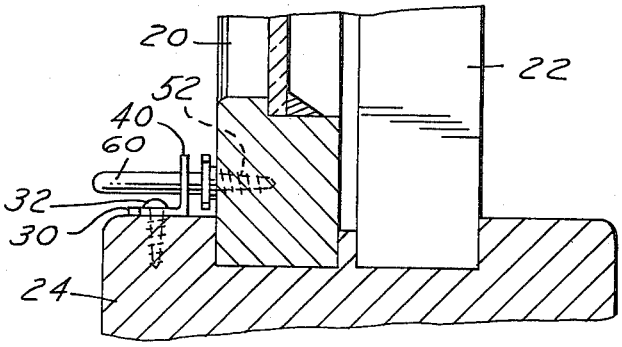
FIG. 3, a section on line 3–3 of FIG. 2.

With reference to the drawings, in FIGS. 1, 2 and 3, a double-sash vertical window assembly is shown with a bottom sash frame 20 and an upper sash frame 22. Viewed from the inside of the window, a left-hand window frame member 24 is shown.

An elongate latch plate is formed in L-shaped cross-section having a fastening leg 30 vertically secured to the frame member 24 by screws 32. The leg 30 has elongate slots 34 to permit slight adjustment laterally.

A second leg 40 extends at right angles to the plate 30 having spaced openings 42 extending to the edge of the plate. A re-entrant shape is achieved by a narrowing throat 44 to prevent dislodging of the lockpin. The plate 30—40 is mounted in spaced relation to the sash 20, i.e., inwardly of the sash to provide clearance. On the lower sash 20 a swivel plate 50 is mounted on a screw 52 with a washer 54 to permit swiveling motion around the headed screw. A lockpin 60 is mounted on plate 50 and extends outwardly normal to the plate. There is room for the plate 50 between the sash 20 and the plate 40. The pin 60 can lodge in an opening 62 when the lower sash is closed. If it is desirable to open the lower sash for ventilation, the plate 50 is swiveled counterclockwise to a non-engaging position and the lower sash raised to a desired position. The plate 50 is then moved clockwise to engage pin 60 in an opening 42. The pin will lock in the opening; and since the assembly is at the top of the lower sash, a person on the outside of the closure cannot reach inwardly and upwardly far enough to dislodge the pin.

When the window is to be closed, the pin 50 is readily released.

Figure 4:
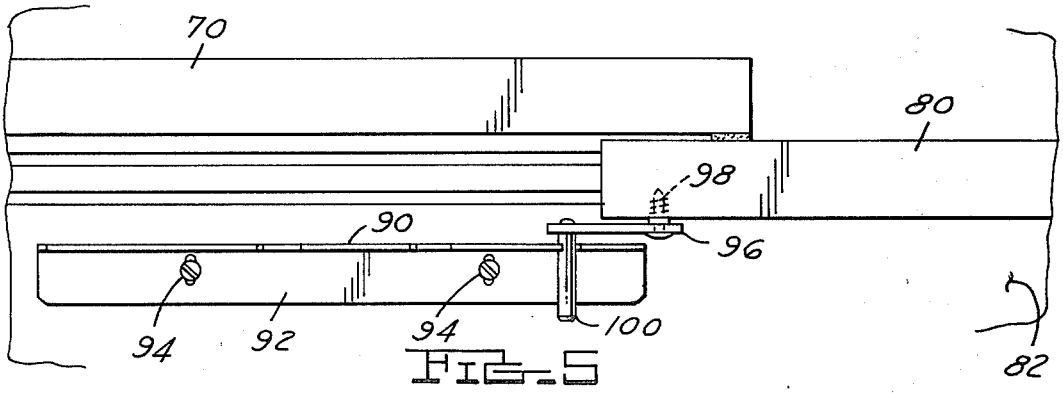
FIG. 4, a plan view of a floor installation for sliding doors.
Figure 5:
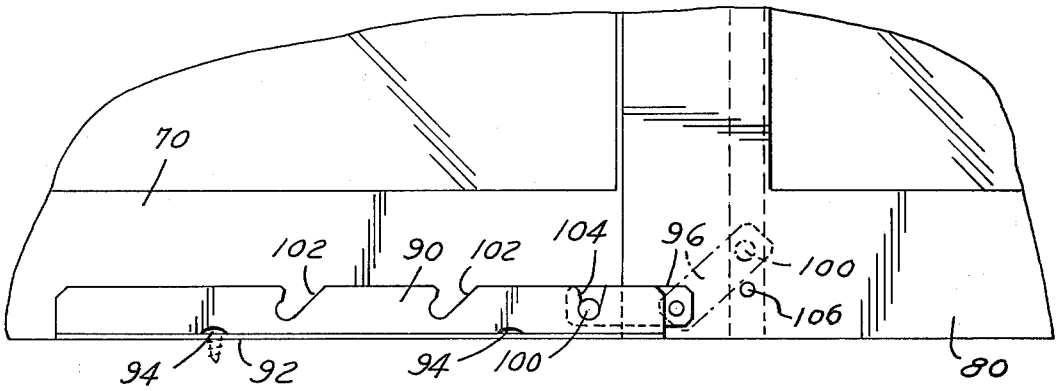
FIG. 5, a side view of the assembly of FIG. 4.
Figure 6:
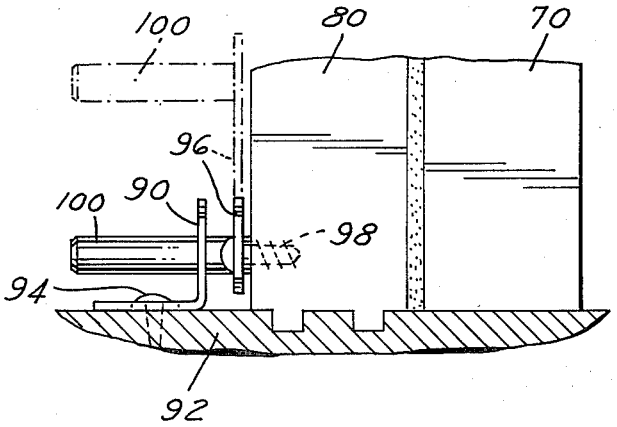
FIG. 6, a view, partially in section, showing the relationship of the parts of FIGS. 4 and 5.

In FIGS. 4, 5 and 6, a similar structure is illustrated for use with a sliding door such as a patio door. A stationary panel and frame 70 has a horizontally sliding panel frame 80 which slides in a suitable track on the floor 22. A latch plate 90 is mounted by an integral plate 92 screwed to the floor by suitable screws 94. On the aluminum frame of the sliding closure, a swivel plate 96 is mounted by a screw 98. This plate carries the extending pin 100.

Plate 90 has angled notches 102 which slant in the direction of the door closing direction. Thus, when pin 100 is lodged in a notch 102, the door 80 cannot be opened further. However, when the door is closed, the pin 100 will ride out of the notches 102 to the lock notch 104 at the closed position. Since the device, when applied to sliding doors, is usually on the floor, this saves stooping to release the lock pin prior to closing the door.

In FIG. 5, a rest pin 106 is provided on the door frame so the swivel plate can be moved to a rest position where it will not interfere with the door movement. It can be moved with the foot to and from the various positions.

It will be noted that in each embodiment, the fastening screws are positioned transversely to any forces which might be applied to open the closures beyond the adjusted position. These elements have considerable shear strength and would prevent unauthorized entry in contrast to devices in which the forces tend to pull out holding screws in an axial direction. It will be appreciated also that though the device in FIGS. 1 to 3 has been shown on the left side of the window, it could also be mounted on the right side by simply turning it to have the latch flange extending inwardly.

What we claim is:

1. A safety lock latch for vertically sliding closures having a sash frame slidable vertically between vertical frame members, (a) an elongate plate having a plurality of spaced, unconnected openings therethrough, each said opening extending to a common edge of said plate, (b) a vertical frame member adjacent and forming a support for a sliding window sash frame, (c) means fastening said elongate plate on said frame member adjacent, parallel to, and overlying but spaced from said sash for sliding clearance, (d) a lock pin to position laterally of said plate dimensioned selectively to enter and engage any one of said spaced openings in said plate, and (e) a swing plate pivotally mounted on said sash frame between said sash and said elongate frame and carrying said lock pin, said swing plate being movable on a horizontal axis to a release position wherein said lock pin clears said elongate plate to allow free vertical movement of said sash and being movable to a substantially vertical position to engage one of said spaced openings to limit the movement of said sash frame until said swing plate is manually shifted to the release position.

* * * * *